US006510857B1

(12) United States Patent
Middleton

(10) Patent No.: US 6,510,857 B1
(45) Date of Patent: Jan. 28, 2003

(54) APPARATUS AND METHOD FOR PREVENTING BACTERIA FROM PROPAGATING AND REMOVING BACTERIA IN DRINK CONVEYING PIPE

(76) Inventor: David Leslie Phillip Middleton, "La Maison" #806, 3-1, Sumiregaoka 2-chome, Takarazuka-shi, Hyogo 665-0847 (JP)

( * ) Notice: Subject to any disclaimer, the term of this patent is extended or adjusted under 35 U.S.C. 154(b) by 0 days.

(21) Appl. No.: 09/554,427

(22) PCT Filed: Oct. 26, 1998

(86) PCT No.: PCT/JP98/04849

§ 371 (c)(1),
(2), (4) Date: Jun. 23, 2000

(87) PCT Pub. No.: WO99/24352

PCT Pub. Date: May 20, 1999

(30) Foreign Application Priority Data

Nov. 12, 1997 (JP) ..... 9-310086

(51) Int. Cl.[7] ..... B08B 9/02

(52) U.S. Cl. ..... 134/22.1; 134/166 C; 134/22.11; 204/157.15; 426/234; 426/237; 422/22

(58) Field of Search ..... 422/22; 134/166 R, 134/166 C, 1, 22.1, 22.11; 204/155, 157.15; 426/234, 237

(56) References Cited

U.S. PATENT DOCUMENTS 5,289,838 A * 3/1994 Odell ..... 134/166 C
5,645,697 A * 7/1997 Middleton et al. ..... 204/155

FOREIGN PATENT DOCUMENTS

JP 8-501520 2/1996

* cited by examiner

*Primary Examiner*—Robert J. Warden, Sr.
*Assistant Examiner*—Sean E. Conley
(74) *Attorney, Agent, or Firm*—Marshall, Gerstein & Borun

(57) ABSTRACT

A conventional apparatus for preventing growth of microbia in a carrier tube by an electromagnetic field has no or little effect. An apparatus 1 serves to prevent growth of microbia propagating themselves on an internal wall of a carrier tube 63 for carrying beer and the like or to remove the microbia. The apparatus 1 comprises a control unit 2 for generating an electric signal including an audio frequency component, a transponder 3 including a coil 31 and a case 32 for housing the coil 31, and means for attaching the transponder 3 to an external wall of the carrier tube 63, and generates an audio electronic signal to be sent through the carrier tube 63 by applying the electric signal to the coil 31.

14 Claims, 6 Drawing Sheets

(a)

(b)

(c)

APPARATUS AND METHOD FOR PREVENTING BACTERIA FROM PROPAGATING AND REMOVING BACTERIA IN DRINK CONVEYING PIPE

FIELD OF THE INVENTION

The present invention relates to an apparatus and method for preventing growth of microbia propagating themselves on an internal wall of a carrier tube for carrying beer and other beverages, or for removing the microbia.

BACKGROUND ART

There has been a beverage supply apparatus comprising, as a supply source, a barrel referred to as a keg which has beer and alcoholic beverages in draft form put therein, the supply source being coupled to an outlet such as a draft cock through a carrier tube (a pipe or duct). Such an apparatus has often been utilized in a hotel or associated industries. For example, an outlet is attached to a bar of the hotel and the keg is provided on the outside of the bar. Beverages such as beer and the like are carried from the keg to the outlet through the carrier tube. Microbia (including bacteria and yeast) easily propagate themselves on the inside of the carrier tube through which the beverages pass. Consequently, it is necessary to periodically perform cleaning by usually causing a flushing fluid or the like to pass into the carrier tube. There has also been proposed an apparatus for preventing the growth of the microbia or removing the microbia by an electromagnetic field in place of the periodic cleaning (see Japanese Laid-Open Patent Publication No. Hei 8-501520, for example). This apparatus has a structure in which a coil is wound around a partial section of a pipe or duct and an electric signal is sent to the coil, thereby preventing growth of microbia in the pipe or duct or removing the microbia.

However, the applicant has investigated effects of the conventional apparatus by experiments. As a result, it has found that the electromagnetic field produces no or less effect of prevention of the growth of the microbia or removal of the microbia.

Furthermore, the following is apparent. Even if the electromagnetic field produces the effect of the prevention of the growth of the microbia or the removal of the microbia, the effect can be obtained only in the proximity of a portion where the coil is wound but cannot be obtained over a whole carrier tube for coupling a keg to an outlet. In addition, it has been found that an audio electronic signal is very effective in the prevention of the growth of the microbia or the removal of the microbia in place of the electromagnetic field.

DISCLOSURE OF THE INVENTION

It is an object of the present invention to provide an apparatus and method for preventing growth of a biofilm of microbia (including bacteria and yeast) which propagate themselves on an internal wall of a carrier tube (pipe or duct) for carrying beer, in particular, barreled beer (draft beer) and other beverages or removing the microbia without requiring periodic use of chemicals which are not preferable environmentally.

In order to solve the above-mentioned problems, the present invention provides an apparatus for preventing growth of microbia propagating themselves on an internal wall of a carrier tube for carrying beverages or for removing the microbia, comprising electric signal generating means for generating an electric signal including an audio frequency component, a transponder including a coil and a case for housing the coil, and means for attaching the transponder to an external wall of the carrier tube, wherein the electric signal is applied to the coil so that an audio electronic signal to be sent through the carrier tube can be generated. Furthermore, the present invention provides a method for preventing growth of microbia propagating themselves on an internal wall of a carrier tube for carrying beverages or for removing the microbia, comprising the steps of generating an electric signal including an audio frequency component, attaching a transponder including a coil and a case for housing the coil to an external wall of the carrier tube, and applying the electric signal to the coil, thereby generating an audio electronic signal to be sent through the carrier tube. According to the apparatus and method, the growth of the microbia can be prevented by the audio electronic signal. The audio electronic signal is sent through the carrier tube so that an effect of the prevention of the growth of the microbia ranges widely in the carrier tube.

In particular, if the electric signal frequency-modulates around a predetermined frequency and the frequency modulation further causes the audio electronic signal to include a harmonics component, the above-mentioned effect can be made remarkable.

It is preferable that the predetermined frequency should be between 1500 Hz and 2500 Hz.

If a face of the transponder which comes in contact with the carrier tube has a concave shape whose section is circular, a state of attachment of the transponder to the carrier tube can be stabilized.

It is preferable that the transponder should be attached near an end of the carrier tube. The reason is that this portion causes the microbia to be increased most easily.

Although carrier tubes for all beverages can be considered as the above-mentioned carrier tube, a carrier tube for carrying beer can be used, for example.

BEST MODE FOR CARRYING OUT THE INVENTION

Typical examples of microbia which deteriorate quality of beer and other beverages include Serratia spp, Achromobacter spp, Flavobacterium spp, Lactobacillus spp, Leuconostoc spp, Pseudomonas spp, Acetobacter spp, Obesobacterium spp, Pediococcus spp, Aeromonas spp, Saccharromyces spp (wild types), Toropulis spp, Schizosaccharromyces spp, Klueverkia spp, and the like. Herein, microbia include bacteria and yeast. The present invention is typically effective in prevention of growth of these microbia in a carrier tube or removal of these microbia in the carrier tube.

An embodiment of the present invention will be described below with reference to the drawings.

Figure 1:
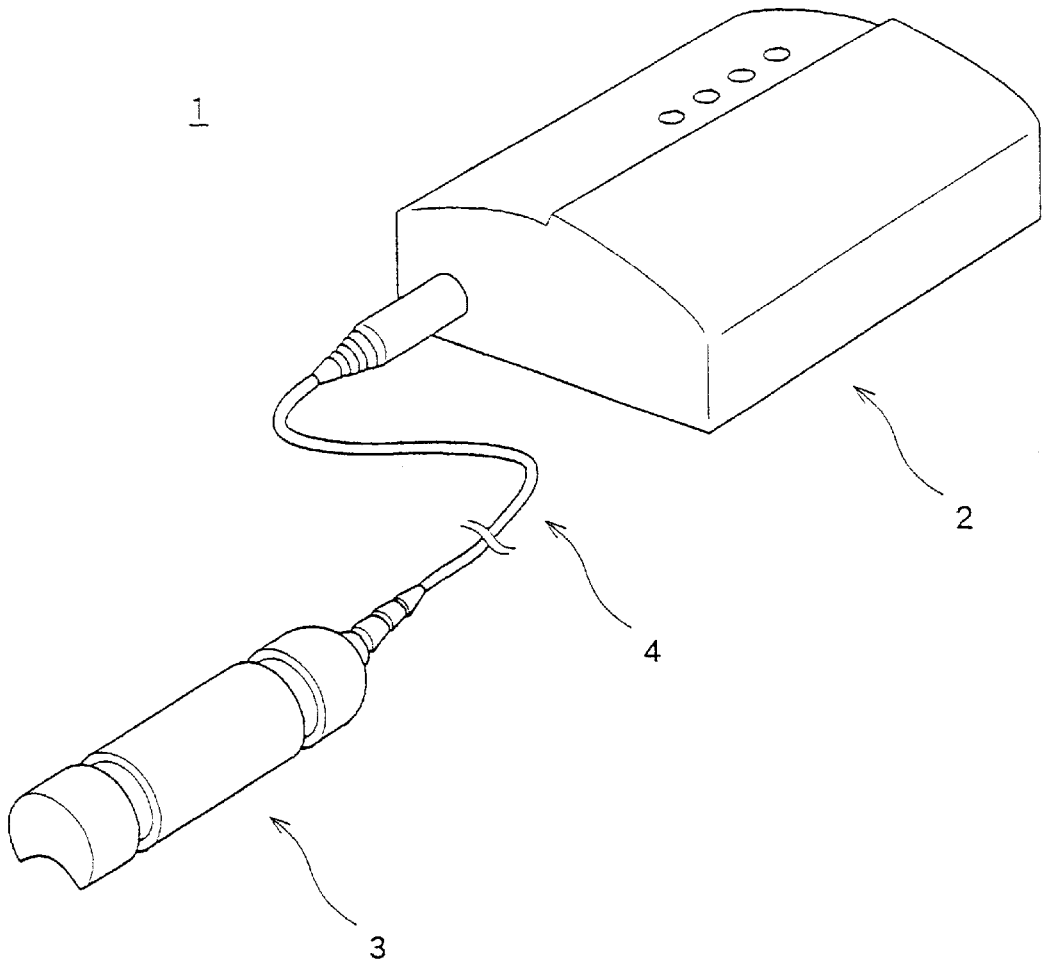
FIG. 1 is a view showing an external appearance of an apparatus according to an embodiment of the present invention.
Figure 2:
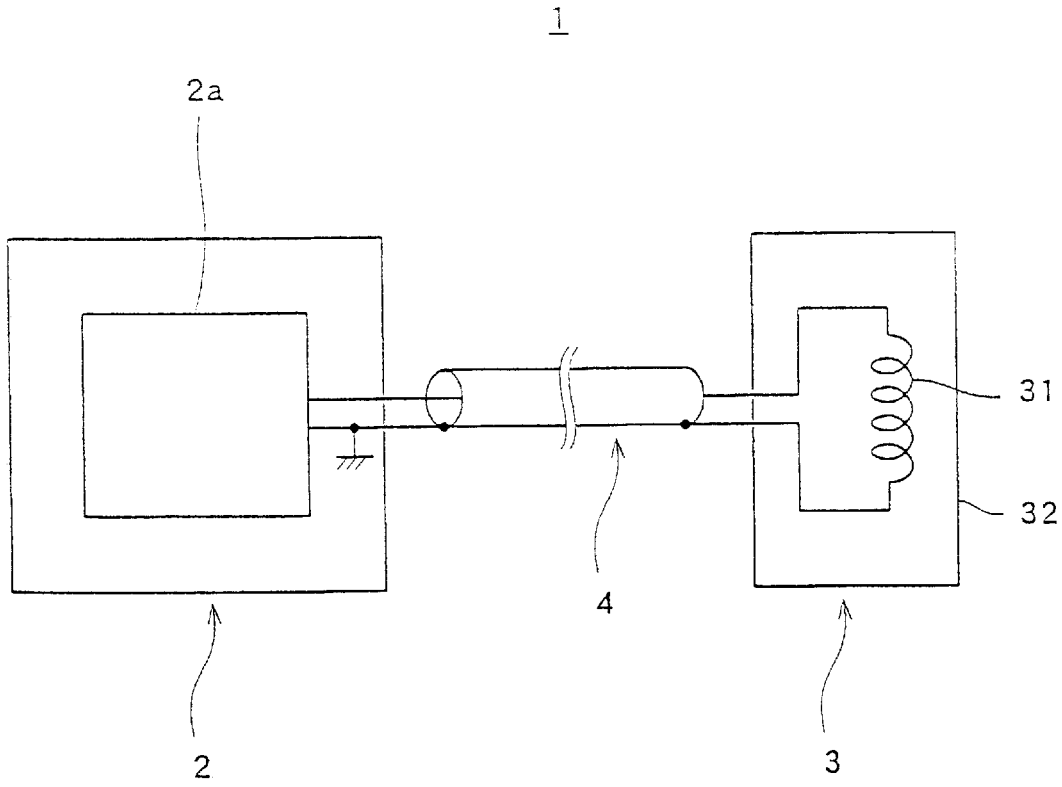
FIG. 2 is a schematic block diagram showing the apparatus according to the embodiment of the present invention.

FIG. 1 is a view showing an external appearance of an apparatus 1 according to an embodiment of the present invention, and FIG. 2 is a schematic block diagram showing the apparatus 1. The reference numeral 1 denotes the apparatus according to the embodiment of the present invention, the reference numeral 2 denotes a control unit, the reference numeral 3 denotes a transponder, and the reference numeral 4 denotes a coaxial cable.

The control unit 2 acting as electric signal generating means has a voltage capacitor oscillator 2*a* provided therein. The voltage capacitor oscillator 2*a* is a main part for generating an electric signal, and serves to generate an electric signal which fluctuates in a range of 2000 Hz ±40 Hz. In other words, the electric signal frequency-modulates in a range of 1960 Hz to 2040 Hz. A center frequency is not always 2000 Hz but any audio frequency can be used. In particular, it is preferable that a specific frequency between 1500 Hz and 2500 Hz should be set to the center frequency. Power is supplied from the outside to the control unit 2 by means of an electric power unit (not shown).

The transponder 3 mainly includes a coil 31 and a case 32 for housing the coil 31. The coil 31 is formed by winding a filament-shaped copper wire around a coil former about 88 times. The coil former has a filament core. The coil 31 has a reactance of 36 microhenry.

The control unit 2 and the transponder 3 are connected through the coaxial cable 4. The electric signal output from the control unit 2 is sent to the coil 31 of the transponder 3 through the coaxial cable 4.

Figure 3:
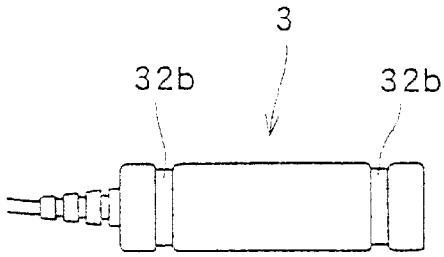
FIG. 3 (*a*) is a side view showing, in detail, a shape of a transponder and the like, FIG. 3 (*b*) is a transverse sectional view showing, in detail, the shape of the transponder and the like, and FIG. 3 (*c*) is a view showing a state in which the transponder is attached to a carrier tube.
Figure 3:
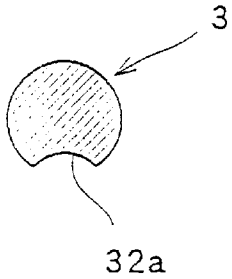
Figure 3:
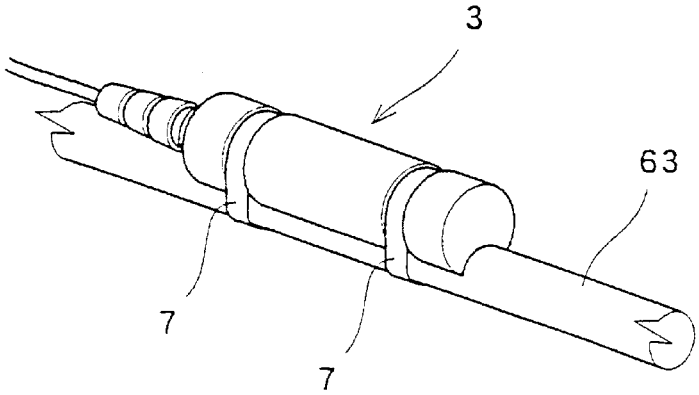

FIG. 3 (*a*) is a side view showing, in detail, a shape of the transponder 3 and the like, FIG. 3 (*b*) is a transverse sectional view showing the same, and FIG. 3 (*c*) is a view showing a state in which the transponder 3 is attached to a carrier tube 63. The transponder 3 has an almost cylindrical shape. A sectional shape of the transponder 3 has a concave portion 32*a* formed like a circular arc as shown in FIG. 3 (*b*). The concave portion 32*a* is formed to stabilize the state of attachment to the carrier tube 63 when the transponder 3 is attached to the carrier tube 63 for beer and the like. Two trenches 32*b* are formed on sides of the transponder 3 in a circumferential direction. The trenches 32*b* are formed in order to fit bind members 7 therein when the transponder 3 is to be attached to the carrier tube 63 by means of the bind members 7.

Figure 4:
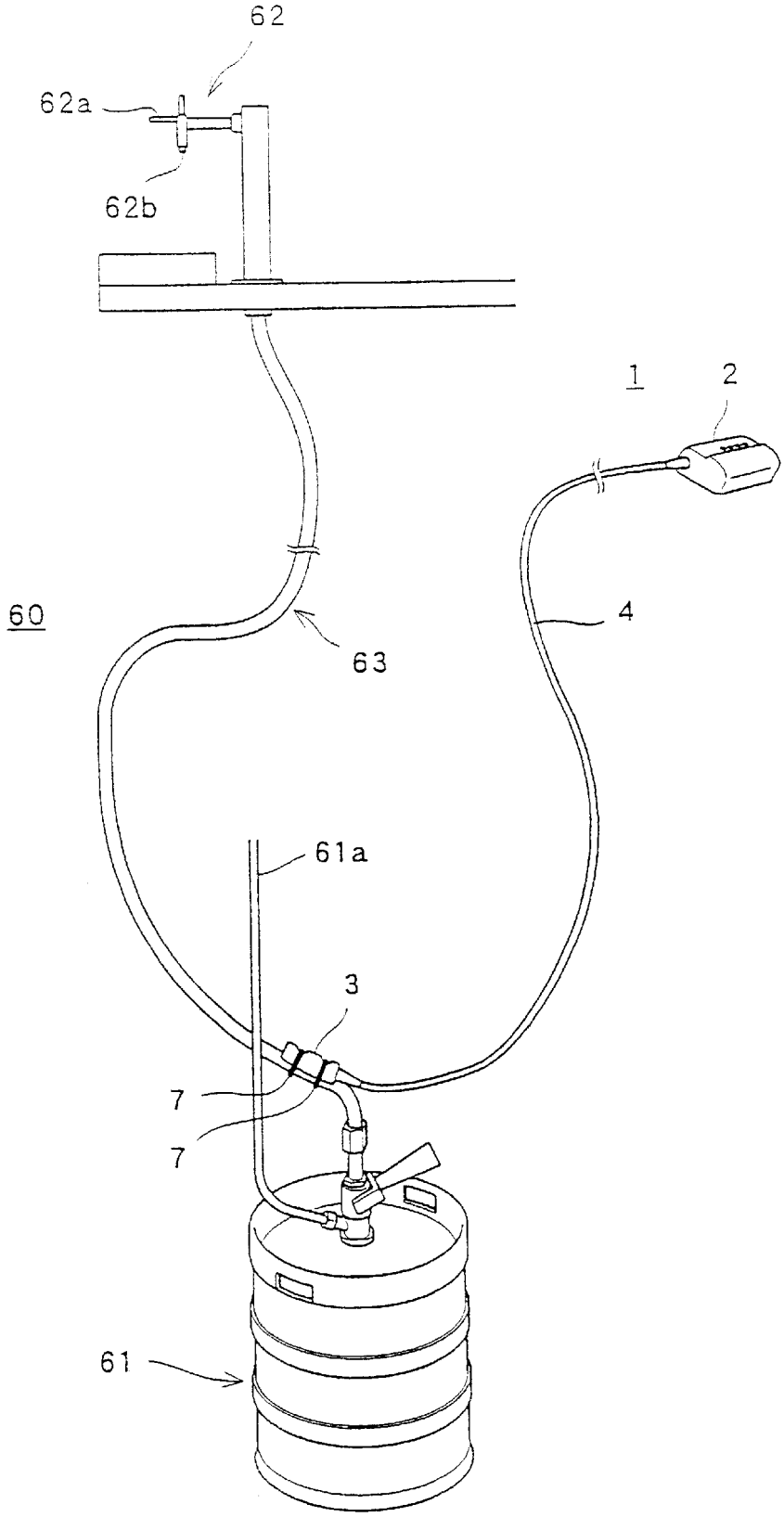
FIG. 4 is a view showing a state of use in which the apparatus according to the present invention is attached to a beer supply apparatus.

FIG. 4 is a view showing a state of use in which the apparatus is attached to a beer supply apparatus 60 including a keg 61, a draft cock 62 and a carrier tube 63. The beer supply apparatus 60 is used for supplying beer in a bar (saloon) and the like.

A small barrel referred to as the keg 61 is filled with beer (draft beer). The inside of the keg 61 is kept at a higher pressure than an atmospheric pressure by pressurized gases sent through a line 61*a*. The keg 61 is usually put on the outside of a bar area. The draft cock 62 is provided in the bar area, and the draft cock 62 and the keg 61 are connected through the carrier tube 63 (pipe, duct). Since an end on the draft cock side of the carrier tube 63 is provided in the bar area, it is kept at a temperature of about 25° C. An end on the keg side of the carrier tube 63 is provided on the outside of the bar area and is kept at a temperature of about 12° C. The carrier tube 63 has a length of 30 m. A material of the carrier tube 63 is not particularly restricted. For example, the carrier tube 63 may be made of polyvinyl chloride. However, it is desirable that the carrier tube 63 should be made of a good conductor such as stainless steel in order to efficiently send an audio electronic signal which will be described below. Since the carrier tube 63 serves to carry beer, it is also referred to as a beer line.

The draft cock 62 is provided with a lever 62*a*. When the lever 62*a* is operated, a slide valve incorporated in the draft cock 62 is opened so that beer is poured out of an outlet 62*b*. Even if the slide valve is closed, the inside of the carrier tube 63 is filled with the beer.

The transponder 3 of the apparatus 1 according to the present invention is attached to an external wall of the carrier tube 63.

As shown in FIG. 4 the transponder 3 is provided near the end on the keg side of the carrier tube 63. The reason is that the beer flows from the keg 61 toward the draft cock 62 and the audio electronic signal which will be described below is sent by using, as a conductor, the beer flowing toward the draft cock 62.

The transponder 3 may be provided near the end on the draft cock side of the carrier tube 63. In this position, air easily enters when the draft cock 62 is opened. Furthermore, a temperature is high. Consequently, microbia propagate themselves most easily. Accordingly, it is effective that the transponder 3 is provided in this position (near the end on the draft cock side of the carrier tube 63).

The transponder 3 is attached to the carrier tube 63 in the following manner. The concave portion 32*a* is caused to come in contact with the external wall of the carrier tube 63. With two bind members 7 fitted in the trenches 32*b*, the transponder 3 is bound to the carrier tube 63 by means of the bind members 7. Thus, the transponder 3 can easily be attached without disassembling the beer supply apparatus 60.

As described above, the electric signal is sent from the control unit 2 to the coil 31 in the transponder 3. Consequently, the transponder 3 generates, in the carrier tube 63, an audio electronic signal which frequency-modulates in a range of 2000 Hz±40 Hz. Harmonics are also generated on the audio electronic signal by the frequency modulation. In other words, the audio electronic signal includes a frequency component which fluctuates around 2000 Hz, and a harmonics component. The harmonics can make effects of the present invention (effects of prevention of growth of microbia and removal of the microbia) more remarkable. Such an audio electronic signal is sent through the carrier tube 63. The transponder 3 is in contact with the carrier tube 63 in the concave portion 32*a*. Consequently, the audio electronic signal is easily generated in the carrier tube 63. Ideally, the audio electronic signal sent through the carrier tube 63 has a voltage level of 200 to 600 millivolts.

The audio electronic signal is sent over a whole length of the carrier tube 63. The carrier tube 63 and the beer acting as a medium filled in the carrier tube 63 function as conductors for sending the audio electronic signal. The audio electronic signal breaks off an electrochemical adhesion function of individual cells of the microbia, thereby preventing growth of a biofilm of the microbia. Consequently, the microbia cannot adhere to an internal wall of the carrier tube 63 well. Thus, the cells cannot be increased.

In the above-mentioned embodiment, one transponder 3 is attached to the carrier tube 63. One transponder can prevent the biofilm of the microbia from growing over the whole length of the carrier tube 63 which is not greater than 30 m. If the carrier tube 63 has a length greater than 30 m, it is preferable that a plurality of transponders should be attached to the carrier tube 63.

If the carrier tube 63 has a length smaller than 30 m, it is preferable that the transponder 3 should be provided near the end on the keg side or the draft cock side of the carrier tube 63. If the carrier tube 63 having a length greater than 30 m, it is preferable that the transponder 3 should be provided near the ends on the draft cock side and the keg side of the carrier tube 63.

While the apparatus according to the present invention has been applied to the beer supply apparatus having only one carrier tube 63 in the above-mentioned embodiment, a plurality of transponders may be connected to one control unit to induce an audio electronic signal to a plurality of carrier tubes at the same time by using the control unit. Consequently, the apparatus according to the present invention is suitable for commercial use in a facility for supplying barreled beer of plural brands or other beverages.

Embodiment

The applicant performed experiments for confirming effects of the apparatus and method according to the present invention. The apparatus, conditions and results of the experiments and the like will be described below. In the experiments, two beer supply apparatus were used as experimental apparatus. Each beer supply apparatus includes a keg filled with beer (barreled draft beer), a dispenser having a draft cock, and a transparent vinyl hose. The keg is coupled to the dispenser through the vinyl hose. By lever operation of the draft cock, beer is poured out of an outlet of the draft cock. A transponder was attached to the vinyl hose of one of the beer supply apparatus. The transponder was not attached to the vinyl hose of the other beer supply apparatus. The dispenser which had been washed with a drug and been stored was used. A brand-new vinyl hose having an inside diameter of 5 mm and a length of 1.5 m was used. Each beer supply apparatus was put in an environment having a room temperature of 30° C., and was used for 29 days without washing. There are four test items: (1) contaminant confirmation test, (2) organoleptic test, (3) microorganism test and (4) foam related test. A testing method and results for each test item are as follows.

(1)Contaminant Confirmation Test

A state of contamination of the vinyl hose for a test period was visually observed. 700 ml of beer was extracted from a draft cock, and 500 ml of beer was then extracted into a seidel. The beer in the seidel was visually observed. A result of the test was shown in Table 1. In the Table 1, "Apparatus" means that a transponder is attached and "No Apparatus" means that the transponder is not attached.

TABLE 1

| Passed days | Contaminant Confirmation Test | | | | Organoleptic Test | | | | Microorganism Test | |
|---|---|---|---|---|---|---|---|---|---|---|
| (Number of | Apparatus | | No Apparatus | | Apparatus | | No Apparatus | | CFU/500 ml | |
| days) | Hose | Beer | Hose | Beer | ① | ② | ① | ③ | Apparatus | No Apparatus |
| 0 | − | − | − | − | | | | | 2016 | 3276 |
| 3 | − | − | − | − | 7/12 | 2/7 | 4/12 | 2/4 | | |
| 6 | − | − | − | − | | | | | | |
| 7 | − | − | − | − | | | | | | |
| 8 | − | − | − | − | 2/10 | 1/2 | 4/10 | 3/4 | 4 | ∞ |
| 9 | − | − | + | − | | | | | | |
| 10 | − | − | + | + | | | | | | |
| 14 | − | − | ++ | ++ | | | | | | |
| 15 | − | − | ++ | ++ | 1/12 | 1/1 | 6/12 | 6/6 | 0 | ∞ |
| 17 | − | − | ++ | ++ | | | | | | |

Contaminant confirmation test
Hose −: No contaminant +: Contaminant ++: Much Contaminant
Beer −: No contaminant +: Contaminant ++: Much Contaminant
Organoleptic test
Apparatus: three-point identification taste of a dispenser with an apparatus and a contrast product (washing dispenser)
No Apparatus: three-point identification taste of a dispenser without an apparatus and a contrast product (washing dispenser)
①: the number of people who give a correct answer/the number of panelists
②: the number of people who give a correct answer and do not like Apparatus/the number of people who give a correct answer
③: the number of people who give a correct answer and do not like No Apparatus/the number of people who give a correct answer.

(2) Organoleptic test

Beer poured from a vinyl hose having a transponder attached thereto and beer poured from a vinyl hose having no transponder were subjected to an organoleptic test using a three-point identification tasting method, and were inspected according to Bengtsson's table. In this test, beer which had been stored at a low temperature of 5° C. in a keg prepared separately from an experimental apparatus was used as the contrast product. The beer which had been filled in less than one week was used as the contrast product. A result of the test is shown in the Table 1.

(3) Microorganism test 200 ml of beer was extracted from a draft cock. Then, 500 ml of beer was extracted as a sample. After the beer was filtrated by means of a membrane filter, HW 25° C. incubation was carried out. A result of the test is shown in the Table 1.

Figure 5:
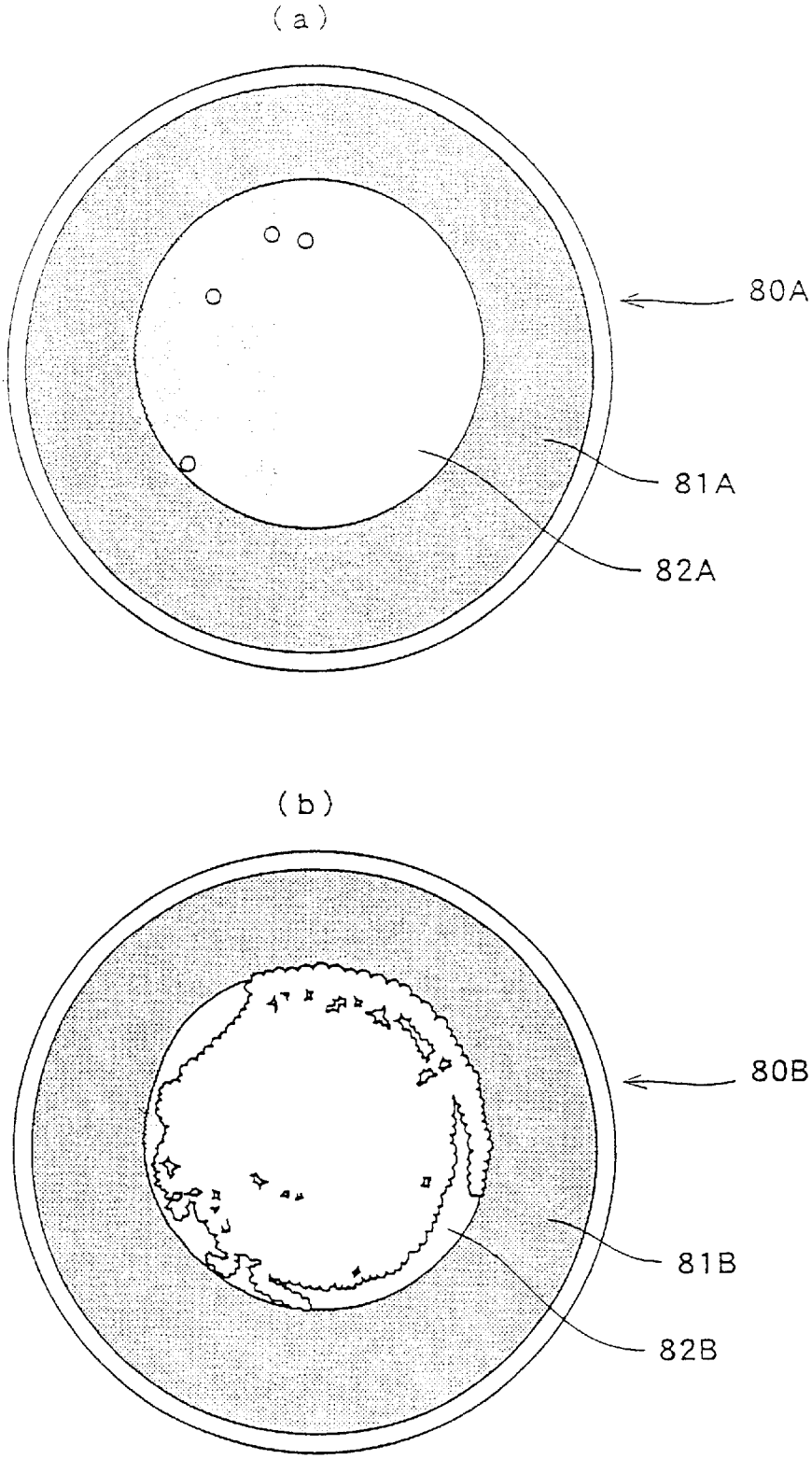
FIG. 5 (*a*) is a view showing a state in which an incubation plate having a colony formed is observed on a condition of "Apparatus", and FIG. 5 (*b*) is a view showing the state on a condition of "No Apparatus"

A microorganism test column in the Table 1 indicates that the number of colonies was counted on an eighth day after the test was started. FIG. 5 shows a state of observation of the incubation on the eighth day. FIG. 5 (*a*) shows the state obtained on a condition of "Apparatus", and FIG. 5 (*b*) shows the state obtained on a condition of "No Apparatus". 80A and 80B denote incubation plates in which medium 81A and 81B are put, and 82A and 82B denote samples applied to the medium 81A and 81B, respectively. In FIG. 5 (*a*), it is apparent that four colonies are formed in the sample 8 A. In FIG. 5 (*b*), it is apparent that countless colonies are formed in the sample 82B.

Figure 6:
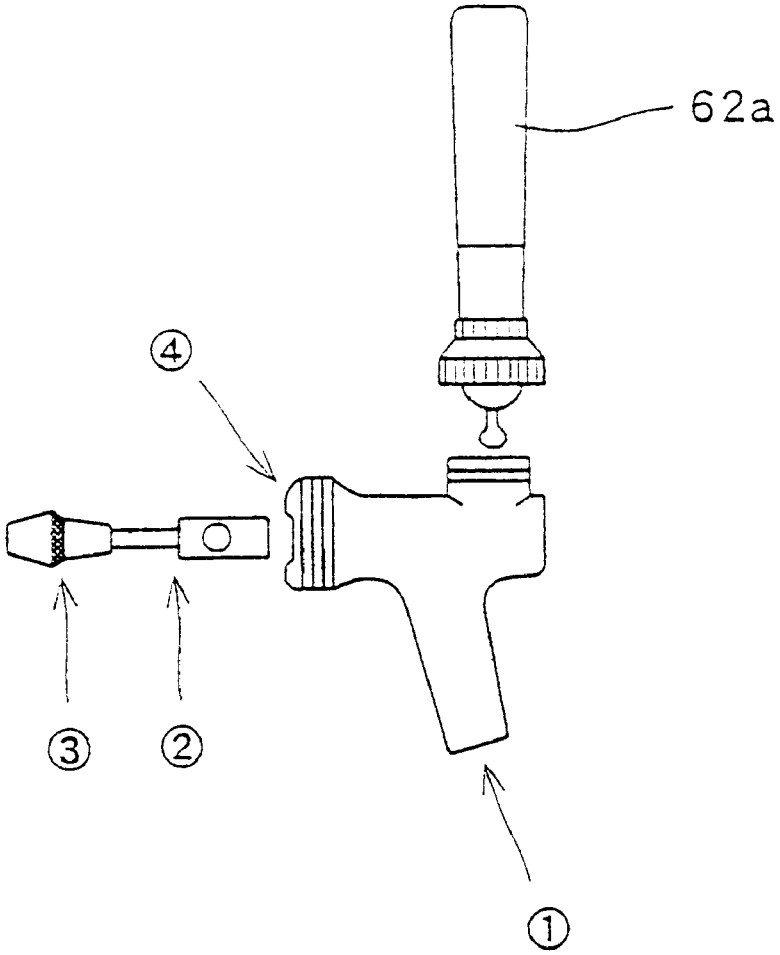
FIG. 6 is an exploded view showing a draft cock.

After a test period of 29 days, the draft cock was disassembled as shown in FIG. 6 to execute a rub test in which each portion of the draft cock was rubbed with a swab to count the number of colonies. A result of the disassembly rub test is shown in Table 2.

TABLE 2

| Rub Test Part | Apparatus | No Apparatus |
|---|---|---|
| ① Inside of Outlet | 0 | 98 |
| ② Slide Valve Rod | 0 | 53 |
| ③ Slide Valve Rod Packing | 0 | ∞ |
| ④ Connecting Portion | 0 | No Execution |

(4) Foam related test

Beer poured from a vinyl hose having a transponder attached thereto and beer poured from a vinyl hose having no transponder were extracted into a 500 ml seidel every five cups per minute through an instantaneous cooling type dispenser in such a manner that the head of the beer is as little as possible. Thus, the height of the head was measured. A result of the test is shown in Table 3.

TABLE 3

| | | | Apparatus | | | No Apparatus | | |
|---|---|---|---|---|---|---|---|---|
| Temperature of barreled beer ° C. | Pressure of forced carbon dioxide kgf/cm$^2$ | Item | Height of head mm | Temperature of beer ° C. | Pouring time/ 350 ml Sec. | Height of head mm | Temperature of beer ° C. | Pouring time/ 350 ml Sec. |
| 22 | 2.7 | Mean | 5.6 | 3.74 | 7.88 | 5.6 | 3.74 | 8.06 |
| | | √v | 0.548 | 0.251 | 0.084 | 0.89 | 0.25 | 0.055 |
| | | Maximum | 6 | 4.1 | 8.0 | 7 | 4.0 | 8.1 |
| | | Minimum | 5 | 3.5 | 7.8 | 5 | 3.3 | 8.0 |
| 30 | 3.5 | Mean | 11.4 | 4.00 | 6.46 | 12.4 | 4.16 | 6.52 |
| | | √v | 0.894 | 0.100 | 0.055 | 0.548 | 0.261 | 0.084 |
| | | Maximum | 12 | 4.1 | 6.5 | 13 | 4.5 | 6.6 |
| | | Minimum | 11 | 3.9 | 6.4 | 12 | 3.8 | 6.4 |

From the results of the four test items described above, it is apparent that contamination in the vinyl hose can be prevented by using the apparatus according to the present invention. Also in a case where the apparatus according to the present invention is used, the beer is not adversely affected.

Furthermore, the applicant performed another experiment on different conditions from the above-mentioned experiments. In this experiment, the apparatus according to the present invention was applied to a beer supply apparatus in which a keg and a draft cock are connected through a carrier tube having a length of 100 m. Thus, the beer supply apparatus was used. The carrier tube was kept at a temperature of 10° C. Under this condition, the beer supply apparatus was continuously used for 6 months. For this period, the growth of the microbia was not detected in the carrier tube. Consequently, it was not necessary to clean the carrier tube.

The present invention is carried out in the above-mentioned form and has the following effects.

(1) According to the apparatus and method of the present invention, growth of microbia can be prevented by an audio electronic signal. The audio electronic signal is sent through a carrier tube so that an effect of prevention of the growth of the microbia can be obtained within a wide range of the carrier tube. Furthermore, a transponder can easily be attached to the carrier tube.

(2) In particular, if an electric signal frequency-modulates around a predetermined frequency and the frequency modulation causes the audio electronic signal to include a harmonics component, the effect of the prevention of the growth of the microbia can be made remarkable.

(3) If a face of the transponder which comes in contact with the carrier tube has a concave shape whose section is circular, the transponder can stably be attached to the carrier tube.

(4) Attachment of the transponder near an end of the carrier tube is especially effective in the prevention of an increase in the microbia.

Although the present invention has fully been described by way of example with reference to the accompanying drawings, it is to be understood that various changes and modifications will be apparent to those skilled in the art. Therefore, unless otherwise such changes and modifications depart from the scope of the invention, they should be construed as being included therein.

I claim:

1. An apparatus for preventing growth of microbia propagating themselves on an internal wall of a carrier tube for carrying beverages or for removing the microbia, comprising:

electric signal generating means for generating an electric signal including an audio frequency component;

a transponder including a coil and a case for housing the coil; and means for attaching the transponder to an external wall of the carrier tube, wherein the electric signal is applied to the coil so that an audio electronic signal to be sent through the carrier tube can be generated.

2. The apparatus according to claim 1, wherein the electric signal frequency-modulates around a predetermined frequency.

3. The apparatus according to claim 2, wherein the audio electronic signal includes a harmonics component by the frequency modulation.

4. The apparatus according to claim 2 or 3, wherein the predetermined frequency is between 1500 Hz and 2500 Hz.

5. The apparatus according to any of claims 1 to 4, wherein a face of the transponder which comes in contact with the carrier tube has a concave shape whose section is circular.

6. The apparatus according to any of claims 1 to 5, wherein the transponder is attached near an end of the carrier tube.

7. The apparatus according to any of claims 1 to 6, wherein the carrier tube serves to carry beer.

8. A method for preventing growth of microbia propagating themselves on an internal wall of a carrier tube for carrying beverages or for removing the microbia, comprising the steps of:

generating an electric signal including an audio frequency component;

attaching a transponder including a coil and a case for housing the coil to an external wall of the carrier tube; and applying the electric signal to the coil, thereby generating an audio electronic signal to be sent through the carrier tube.

9. The method according to claim 8, wherein the electric signal frequency-modulates around a predetermined frequency.

10. The method according to claim 9, wherein the audio electronic signal includes a harmonics component by the frequency modulation.

11. The method according to claim 9 or 10, wherein the predetermined frequency is between 1500 Hz and 2500 Hz.

12. The method according to any of claims 8 to 11, wherein a face of the transponder which comes in contact with the carrier tube has a concave shape whose section is circular.

13. The method according to any of claims 8 to 12, wherein the transponder is attached near an end of the carrier tube.

14. The method according to any of claims 8 to 13, wherein the carrier tube serves to carry beer.

* * * * *